United States Patent [19]

Chaintrier et al.

[11] 4,047,571

[45] Sept. 13, 1977

[54] AUTOMATIC FIRE EXTINGUISHING SYSTEM FOR A BUILDING HAVING CENTRAL AIR CONDITIONING

[76] Inventors: Guy Chaintrier, Les Drouillards, Generac (Gironde), XVeme; Christian Chaintrier, 8 Rue Frederic Magisson, Paris, XVeme, both of France

[21] Appl. No.: 568,060

[22] Filed: Apr. 14, 1975

[30] Foreign Application Priority Data

Apr. 12, 1974 France ..... 74.13075

[51] Int. Cl.[2] ..... A62C 5/02; A62C 37/00

[52] U.S. Cl. ..... 169/60; 62/180; 169/15

[58] Field of Search ..... 169/5, 7, 13-16, 169/54, 56, 60, 61, 64; 98/33 R, 31; 62/180; 236/49

[56] References Cited

U.S. PATENT DOCUMENTS

| | | | |
|---|---|---|---|
| 2,150,252 | 3/1939 | Shure | 98/33 R |
| 2,590,348 | 3/1952 | Rider | 169/14 |
| 3,303,886 | 2/1967 | Tattersall et al. | 169/5 X |
| 3,352,225 | 11/1967 | Tfiske | 98/33 R |
| 3,465,827 | 9/1969 | Levy et al. | 169/15 X |
| 3,738,572 | 6/1973 | Hall, Jr. | 236/49 |
| 3,831,318 | 8/1974 | Richmond | 169/61 X |
| 3,877,243 | 4/1975 | Kramer | 62/180 |
| 3,884,133 | 5/1975 | Miller | 169/61 X |

*Primary Examiner*—Evon C. Blunk
*Assistant Examiner*—Andres Kashnikow
*Attorney, Agent, or Firm*—Young & Thompson

[57] ABSTRACT

An automatic fire extinguishing system acting through aerated foam filling of the room on fire. The automatic fire extinguishing system includes an air conditioning system comprising a central blower with air feeding ducts having an air inlet in each room, an air outlet in each room communicating with an exhaust duct, a screen occupying the section of each of the air inlets, a foaming mixture generator for spraying the screen with foaming mixture arranged near the air inlet and at least a fire detector in each room, the fire detector controls the foaming mixture generator of the room.

9 Claims, 1 Drawing Figure

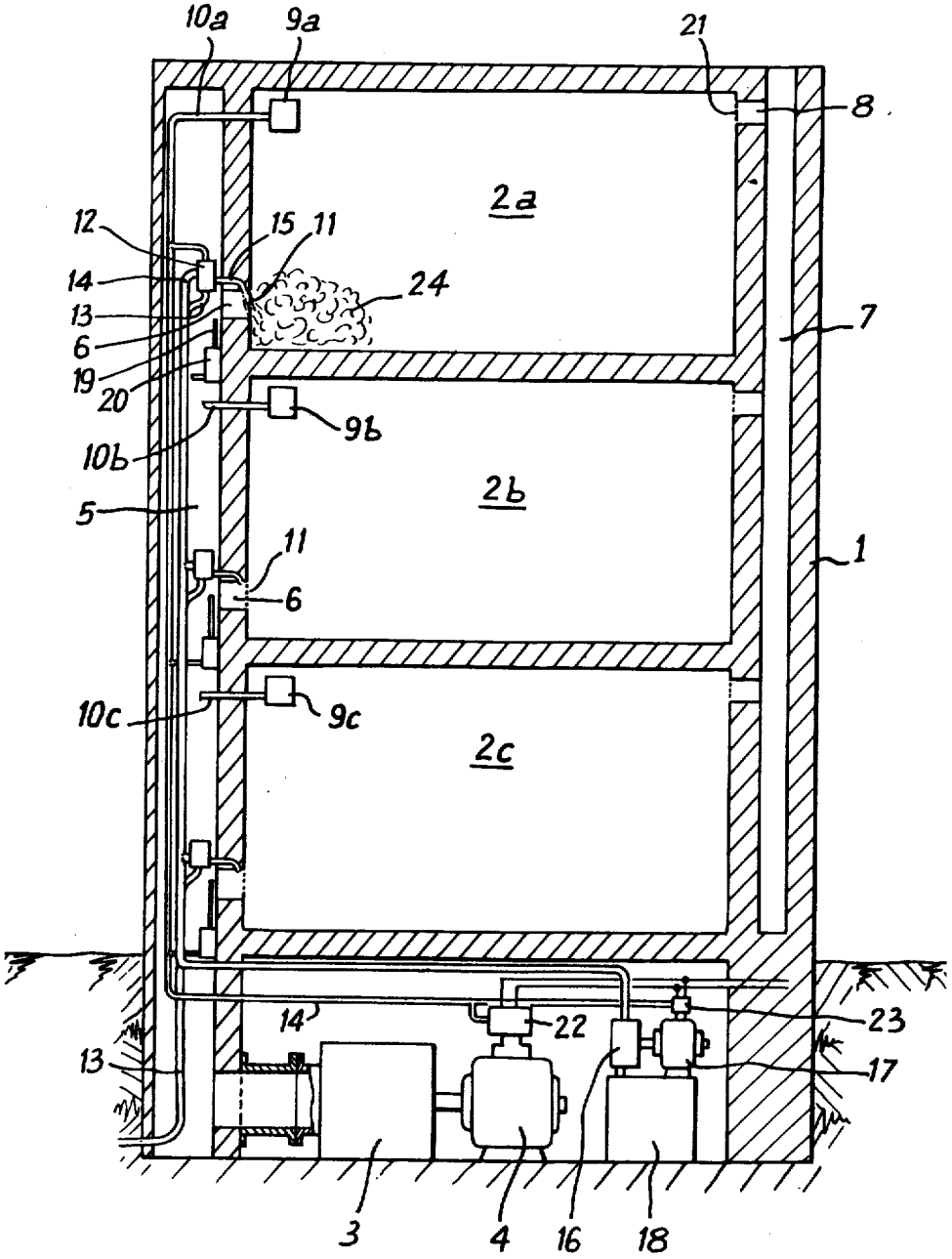
10a
9a
21
8
2a
12
15
11
14
24
13
7
6
19
20
9b
10b
2b
5
11
1
6
10c
9c
2c
14
22
23
13
17
3
4
16
18

AUTOMATIC FIRE EXTINGUISHING SYSTEM FOR A BUILDING HAVING CENTRAL AIR CONDITIONING

This invention relates to a fire extinguishing system for extinguishing fire in enclosures ventilated by pumped air, such as dwellings, offices, shops, warehouses, conference rooms, mine galleries and tunnels, vessels and large aircraft.

Until now automatic fire extinguishing systems for the rooms of dwellings or other compartmented structures were constituted by networks of nozzles or sprinklers placed under the ceiling of the room and intended to spray water on fire. This protection is efficacious in most cases but it has the disadvantage of requiring a relatively large amount of water which is liable to damage the room, and its contents, in particular electric installations. Moreover, watering should be continued until full extinction of the seat of the fire.

It has been suggested to fight fires with foams, in particular very low density and high stability foams. These foams do not have the disadvantages of sprinklers. There is very little constitutive water and the foams do not damage the premises and electric installations, even the most delicate ones. The foams are relatively stable in spite of their destruction by bursting of the bubbles in contact with the fire and owing to their method of action by stifling of the fire by the steam and cooling arising from the vaporization heat, they act for a long time. They do not require to be brought direct on to the seat of the fire towards which they go by convection and they fill the premises progressively. Lastly, it is perfectly possible to breathe inside the foam owing to its air content. The foam protects from radiation and convection, and this reduces or prevents damage to objects or risks of burning people near the source of the fire.

The disadvantage of fixed protection installations using foams is that they require a foam generator for each room to be protected, this generator consisting of a blower driven by an electric or hydraulic motor, a water mixer ensuring the mixture of water and foaming agent and, lastly, a screen arranged in the delivery piping of the blower and sprayed with the foaming mixture, the outlet aperture of the device being protected by automatic doors to prevent the first flames from damaging the screen. This device is cumbersome, inaesthetic and vulnerable when it is driven by an electric motor. Lastly, it is costly because it is essential to provide for one generator per room to be protected.

This invention applies to enclosures ventilated by pumped air, and this is the case, in particular, for very high buildings with non-opening bays which consequently have a forced ventilation with distribution and evacuation conduits for renewal of air, that is, a so-called air conditioning system. However it is not limited to this application and may be implemented in any premises having at least one pumped air feed by general circuit or independent air-conditioning system.

The automatic fire extinguishing system according to this invention includes an air conditioning system comprising a central blower with air feeding ducts having an air inlet in each room, an air outlet in each room communicating with an exhaust duct, a screen occupying the section of each of said air inlets, a foaming mixture generator for spraying the screen with said foaming mixture arranged near said air inlet and at least a fire detector in each room, said fire detector controlling the foaming mixture generator of the said room.

The fire detector can be of any known type but it consists preferably of a thermo-velocimetric device using speed of expansion of the air contained in an enclosed enclosure with controlled escape flow.

The foaming mixture generator spraying the screen preferably consists of a mixer for mixing water and foaming or surface active agent, arranged upstream of the screen with two feeds of water and foaming agent, each one controlled by a valve, the two valves being piloted by the said fire detector.

To avoid the delivery of the foam towards the ducts exhausting and extracting the air, the air outlets are obstructed by a screen with fine mesh.

In the case of an existing air conditioning system not ensuring a sufficiently fast renewal of air in the room, that is to say sufficient flow of air to engender within a given time the volume of foam required to fill the room, the blower driving motor can be a motor with variable speed in particular an asynchronous motor the high speed of which is controlled by all the fire detectors so as to increase speed and accordingly the flow of air when one of said detectors detects fire. It is also possible to provide for throttling shutters on the existing feed or exhausting ducts, these shutters being controlled by the fire detector to ensure a preferred flow towards the room on fire. The two means can be combined to maintain a flow of normal air in the premises not on fire, notwithstanding the larger flow of the ventilators or, should throttlings be provided for on the exhaust ducts, create an overpressure in the premises not on fire, opposing the entry of smoke and noxious gases.

According to the present invention, transmissions of data and control impulses are preferably of a hydraulic or pneumatic type, the transmission channels consisting of metallic tubes. The transmission tubes and piping introducing water and foaming agent are preferably lodged inside the ducts of the air conditioning system. In fact, pneumatic or hydraulic means of transmission are more fire-resistant than electric means, safety being even more increased by their implementation in air conditioning ducts which run less the risk of being heated by the fire or hot gases, than exhausting ducts.

A comparison will now be made between the characteristics of a known fire extinguishing system for spraying water by sprinklers and that of a system according to the invention.

The water distribution network for the sprinklers and the sprinklers themselves should be provided for as from the beginning of the study of the building to be protected. On the contrary, the system according to the invention, can be assembled in an existing air conditioning system without changing aesthetics and without visible components.

Consumption of water in case of defense by watering is about 7.5 liters/sq.m./minute. In the case of foam, the quantity of water is one liter per cubic meter of foam. According to statistics, 15 minutes of spraying are required to extinguish a beginning of a fire in a room 3 meters high, and this corresponds to 112.5 liters per sq.m. of floor. In the case of foam, three cubic meters of foam will be required and this corresponds to 3 liters of water, even assuming the foam is partially destroyed by the heat of the fire and twice more is needed, consumption will be 6 liters of water per sq.m, that is to say 18 times less. Moreover, foam being very stable, the protection it ensures lasts several hours whereas the sprinklers must be fed continuously in particular to avoid a further outbreak of the fire. Pressure of water required being the same for both systems and approximately five bars, the capacity of the source of water can be reduced approximately ten times. The volume of foaming surface active agent is equal to 1.5% of the volume of water. Therefore, should protection by sprinklers require a reserve of water estimated at 20 cubic meters, 2 cubic meters and 300 liters of foaming agent will be sufficient for the same protection by the system according to the present invention.

It being possible to control propagation of foam easily and as the foam does not wet, periodical tests of proper operation can be carried out, and this is more difficult with sprinklers.

Lastly, although the foam cannot act punctually like sprinklers, and must fill the whole volume of the room on fire, it should be recalled that it has numerous other advantages, such as that of acting in spots not accessible by sprinklers, for example under furniture, and not damaging furniture and electric installations, even delicate ones, not touched direct by the fire, rejecting smoke and creating a breathable medium, protecting persons liable to be imprisoned in the room from phenomena of convection and thermal radiation.

An embodiment of the present invention will be described hereinafter with reference to the drawing which is a schematic view of a system in accordance with the present invention.

Referring to the drawing in detail the system is applied to a multi-story building 1 which for the sake of simplification is shown as comprising only three independant rooms 2a, 2b and 2c but which may comprise a large number of them. Said building is provided with a known air conditioning system comprising a blower 3 driven by an electric motor 4 preferably a two speed asynchronous motor. The air blown by said blower 3 is distributed to the rooms in a known manner by ducts 5 with outlets 6 for the ducts opening in each room. The air is exhausted from the rooms by an exhaustion duct 7 opening in each room by inlets 8 as usual.

The system according to the present invention is applied to such a building and includes a fire detector 9 in each room said detector being of a known type such that it generates an increase of pressure when a sudden temperature rise or smoke occurs. Said pressure is transmitted to a pipe system 10 which is used as controlling system for the fire extinguishing system only that corresponding to the room 2a being shown. Said fire extinguishing system comprises for each room a screen 11 closing the air conditioning air inlet 6, a foaming mixture generator 12 which mixes water provided through water duct 13 with a surface active agent fed through duct 14 and spreads said mixture on screen 11 through a duct 15. The surface active agent is sent to the duct system through a pump 16 driven by an electric motor 17, the pump 16 being fed from a tank 18.

A shutter 19 is provided in front of each air inlet 6 to partially close the same and is driven by a motor such as a fluid cylinder 20. A screen 21 is also provided in front of outlet opening 8 through which the air is exhausted from the room.

The pressure in the pipe system 10a corresponding to the room in which fire has been detected by fire detector 9a is fed to all the fluid cylinders 20 except that of the corresponding room to partially close the inlet openings 6, to the foaming mixture generator 12 corresponding to the room in which the fire has been detected, to a pressure operated switch 22 switching the electric motor 4 to the high speed and to a pressure operated switch 23 which feeds electric motor 17. Accordingly the flow and pressure of the conditioning air are increased but the flows to all the rooms except that on fire are restricted by shutters 19 so as to be normal and that in the room in which fire has occurred is increased; motor 17 and pump 16 are started to feed surface active agent to foaming mixture generators 12 but only that corresponding to the room on fire oerates to sprinkle the screen 11 with foaming mixture so as to form a foam 24 which fills the room 2a at a rate equal about to the rate of renewal of the air by the air conditioning system, this last rate being usually 10 times an hour so that the room is filled with extinguishing foam which is prevented from entering the exhaust duct 7 by screen 21 in about 6 minutes such a delay being considered as valuable for all known automatic fire extinguishing systems.

What is claimed is:

1. In a fire extinguishing system for multicompartmented buildings said system comprising: the combination of a trunk-line duct system having an upstream inlet and a plurality of downstream branch duct outlets, at least one of said duct outlets being in each compartment to be protected, an air conditioning system having an outlet connected to said duct system inlet for providing an air stream in said duct system, a high expansion foam plug generator located adjacent at least one branch duct outlet for each compartment to be protected and control means associated with each of said compartments to be protected for simultaneously energizing said air conditioning system and said foam plug generator in response to the presence of a fire in said compartment.

2. A system as set forth in claim 1 wherein said foam plug generating means in each of said compartments comprises:

a. a porous membrane positioned across said branch duct outlets,
b. valve means,
c. a source of foam forming solution, and
d. a nozzle connected to said source of foam forming solution, said nozzle being located intermediate said inlet and said outlet for directing a spray of said foam forming solution against said membrane upon actuation of said valve means by said control means to thereby form said high expansion fire extinguishing foam.

3. A system as set forth in claim 2 wherein said source of foam forming solution further comprises blending means having an outlet connected to said nozzle and a first and second inlet, said first inlet being connected to a source of water under pressure and said second inlet being connected to tank means containing foam forming concentrate.

4. An automatic fire extinguishing system for a building having a plurality of rooms, a central air blower, an air ducts for feeding air from said blower to an air inlet in each room, an air outlet in each room communicating with an exhaust duct, a screen covering each said air inlet, a foaming mixture generator individual to each said screen for spraying on its associated screen a foaming liquid mixture, a fire detector in each said room, said fire detector actuating only the said associated foaming mixture generator upon detection of a fire in the associated said room, and a variable speed motor for driving said blower, said motor having high speed and low speed, said motor operating at low speed in the absence of a fire, each said fire detector actuating said motor to operate at said high speed.

5. A system as claimed in claim 4, there being a screen over each said air outlet to retain foam in the associated sad room.

6. A system as claimed in claim 4, said foaming mixture generator comprising a mixer having two feed pipes for water and foaming agent and a delivery pipe with a sprayer for spraying said foaming mixture on said screen.

7. A system as claimed in claim 4, and shutters for the air inlets of each said room, all the shutters other than that associated with the room on fire being responsive to said detector of said room on fire to close partially so as to insure preferred flow of air toward the room on fire.

8. A system as claimed in claim 4, and shutters for the air inlets of each said room, all the shutters other than that associated with the room on fire being responsive to said detector of said room on fire to close partially so as to insure preferred flow of air toward the room on fire.

9. A system as claimed in claim 4, and conduit means for said water and foaming agent and for the transmission of controlled signals from said fire detectors, said conduit means being disosed inside duct work of said air conditioning system.

* * * * *